US012043511B2

(12) United States Patent
Yang

(10) Patent No.: US 12,043,511 B2
(45) Date of Patent: Jul. 23, 2024

(54) SHEET FEEDING MECHANISM

(71) Applicant: Foxlink Image Technology Co., Ltd., New Taipei (TW)

(72) Inventor: Chih Yuan Yang, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 453 days.

(21) Appl. No.: 17/532,643

(22) Filed: Nov. 22, 2021

(65) Prior Publication Data

US 2022/0340385 A1 Oct. 27, 2022

(30) Foreign Application Priority Data

Apr. 22, 2021 (CN) ..... 202120840649.X

(51) Int. Cl.
*B65H 5/06* (2006.01)
*B65H 29/12* (2006.01)

(52) U.S. Cl.
CPC ..... *B65H 5/066* (2013.01); *B65H 5/062* (2013.01); *B65H 29/125* (2013.01); *B65H 2301/331* (2013.01); *B65H 2402/41* (2013.01); *B65H 2402/54* (2013.01); *B65H 2404/1341* (2013.01); *B65H 2511/20* (2013.01); *B65H 2601/272* (2013.01); *B65H 2701/1914* (2013.01); *B65H 2801/39* (2013.01)

(58) Field of Classification Search
CPC ..... B65H 2402/54; B65H 2404/1341; B65H 2404/144; B65H 2404/1441; B65H 2404/1442; B65H 5/066; B65H 2301/331
See application file for complete search history.

(56) References Cited

U.S. PATENT DOCUMENTS 8,851,270 B2 * 10/2014 Dong ..... H04N 1/00795 198/782

* cited by examiner

*Primary Examiner* — Jeremy R Severson
(74) *Attorney, Agent, or Firm* — Lin & Associates Intellectual Property, Inc.

(57) ABSTRACT

A sheet feeding mechanism includes a feeding path, at least one card feeding roller mounted to the feeding path, at least one paper feeding roller coaxial with the at least one card feeding roller, at least one card idle roller contacting with the at least one card feeding roller, at least one paper idle roller contacting with the at least one paper feeding roller, at least one elastic unit connected to the feeding path, and a stroke limiting unit. The at least one elastic unit is fastened to the feeding path. The at least one elastic unit has a stretching stroke. The stroke limiting unit controllably shortens the stretching stroke.

8 Claims, 10 Drawing Sheets

SHEET FEEDING MECHANISM

CROSS-REFERENCE TO RELATED APPLICATION

The present application is based on, and claims priority from, China Patent Application No. 202120840649.X, filed Apr. 22, 2021, the disclosure of which is hereby incorporated by reference herein in its entirety.

BACKGROUND OF THE INVENTION

1. Field of the Invention

The present invention generally relates to a sheet feeding mechanism, and more particularly to a sheet feeding mechanism which is capable of avoiding paper from causing a skew and has two feeding modes.

2. The Related Art

Referring to FIG. 8, FIG. 9 and FIG. 10, because thicknesses and weights of a card and paper are different, a portable scanner often includes multiple groups of feeding rollers so as to make that the portable scanner is based on a premise of being without increasing a whole dimension, and the portable scanner feeds carriers with different thicknesses and weights.

A conventional sheet feeding mechanism shown in FIG. 8 and FIG. 9 is provided with a paper feeding roller assembly 51. The paper feeding roller assembly 51 is disposed in a feeding path of the conventional sheet feeding mechanism, and an additional card feeding roller assembly 52 is disposed to one side of the feeding path. The paper feeding roller assembly 51 includes an idle roller 53. The card feeding roller assembly 52 includes another idle roller 53. Compare the idle roller 53 in the paper feeding roller assembly 51 with the idle roller 53 in the card feeding roller assembly 52, the idle roller 53 in the card feeding roller assembly 52 has a higher elasticity coefficient, so a larger normal clamping force is exerted on a card 54 for clamping the card 54 and facilitating a card feeding. The conventional sheet feeding mechanism has two feeding roller assemblies, so the conventional sheet feeding mechanism can feed the card 54 and paper 55 in the same feeding path, and then a space utilization is improved.

However, when the ordinary paper 55 is fed, the paper 55 is in contact with the card feeding roller assembly 52 and the paper feeding roller assembly 51 simultaneously, consequently, uneven transmitting forces are exerted on both sides of the paper 55 and the paper 55 is easily skewed.

Therefore, it is necessary to provide an innovative sheet feeding mechanism which is capable of avoiding paper from causing a skew and has two feeding modes.

SUMMARY OF THE INVENTION

An object of the present invention is to provide a sheet feeding mechanism. The sheet feeding mechanism includes a feeding path, at least one card feeding roller mounted to the feeding path, at least one paper feeding roller coaxial with the at least one card feeding roller, at least one card idle roller contacting with the at least one card feeding roller, at least one paper idle roller contacting with the at least one paper feeding roller, at least one elastic unit connected to one side of the at least one card idle roller, and a stroke limiting unit. The at least one elastic unit is fastened to one side of the feeding path. The at least one elastic unit has a stretching stroke. The stroke limiting unit controllably shortens the stretching stroke. When the stretching stroke is without being shortened by the stroke limiting unit, the at least one card idle roller is located in the stretching stroke, when the stretching stroke is shortened by the stroke limiting unit, the at least one card idle roller is located outside a range of the stretching stroke.

Another object of the present invention is to provide a sheet feeding mechanism. The sheet feeding mechanism includes a feeding path, two groups of card feeding rollers mounted to the feeding path, two groups of paper feeding rollers, two groups of card idle rollers, two groups of paper idle rollers, two groups of elastic units and a stroke limiting unit. Each group of the paper feeding rollers are coaxial with one group of the card feeding rollers. The two groups of the card idle rollers are in contact with the two groups of the card feeding rollers, respectively. The two groups of the paper idle rollers are in contact with the two groups of the paper feeding rollers, respectively. The two groups of the elastic units are fastened to an upper side of the feeding path. Each card idle roller is connected with one elastic unit. Each elastic unit has a stretching stroke. The stroke limiting unit controllably shortens the stretching stroke. When the stretching stroke of each elastic unit is shortened, the two groups of the card idle rollers exceed a range of the stretching stroke, when the stretching stroke is lengthened, the two groups of the card idle rollers are in the range of the stretching stroke.

Another object of the present invention is to provide a sheet feeding mechanism. The sheet feeding mechanism includes a feeding path, two groups of card feeding rollers mounted to the feeding path, two groups of paper feeding rollers, two groups of card idle rollers, two groups of paper idle rollers, two groups of elastic units, an orienting unit and a stroke limiting unit. Each group of the paper feeding rollers are coaxial with one group of the card feeding rollers. The two groups of card idle rollers are in contact with the two groups of the card feeding rollers, respectively. Each group of the card idle rollers are mounted around a pivoting shaft. The two groups of the paper idle rollers are in contact with the two groups of the paper feeding rollers, respectively. The two groups of elastic units are fastened to an upper side of the feeding path. Each card idle roller is connected with one elastic unit. Each elastic unit includes a sliding pin. Each elastic unit has a stretching stroke. The orienting unit is fastened to one side of a top of the feeding path. The orienting unit has two groups of orienting slots. The two groups of the orienting slots are disposed towards free ends of the pivoting shafts of the two groups of the card idle rollers. The sliding pins of the two groups of the elastic units are slidably positioned in the two groups of the orienting slots of the orienting unit. The stroke limiting unit controllably shortens the stretching stroke. When the stretching stroke of each elastic unit is shortened, the two groups of the card idle rollers exceed a range of the stretching stroke, when the stretching stroke is lengthened, the two groups of the card idle rollers are in the range of the stretching stroke.

As described above, the stroke limiting unit of the sheet feeding mechanism can adjust a length of the stretching stroke of each elastic unit for controlling a normal clamping force exerted on the two groups of the card feeding rollers by the two groups of the card idle rollers, so that the sheet feeding mechanism realizes that paper and a card are fed through the same feeding path, correspondingly the sheet feeding mechanism has two feeding modes. Furthermore, even transmitting forces are exerted on two sides of the paper, so the sheet feeding mechanism is capable of avoiding the paper from causing a skew.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
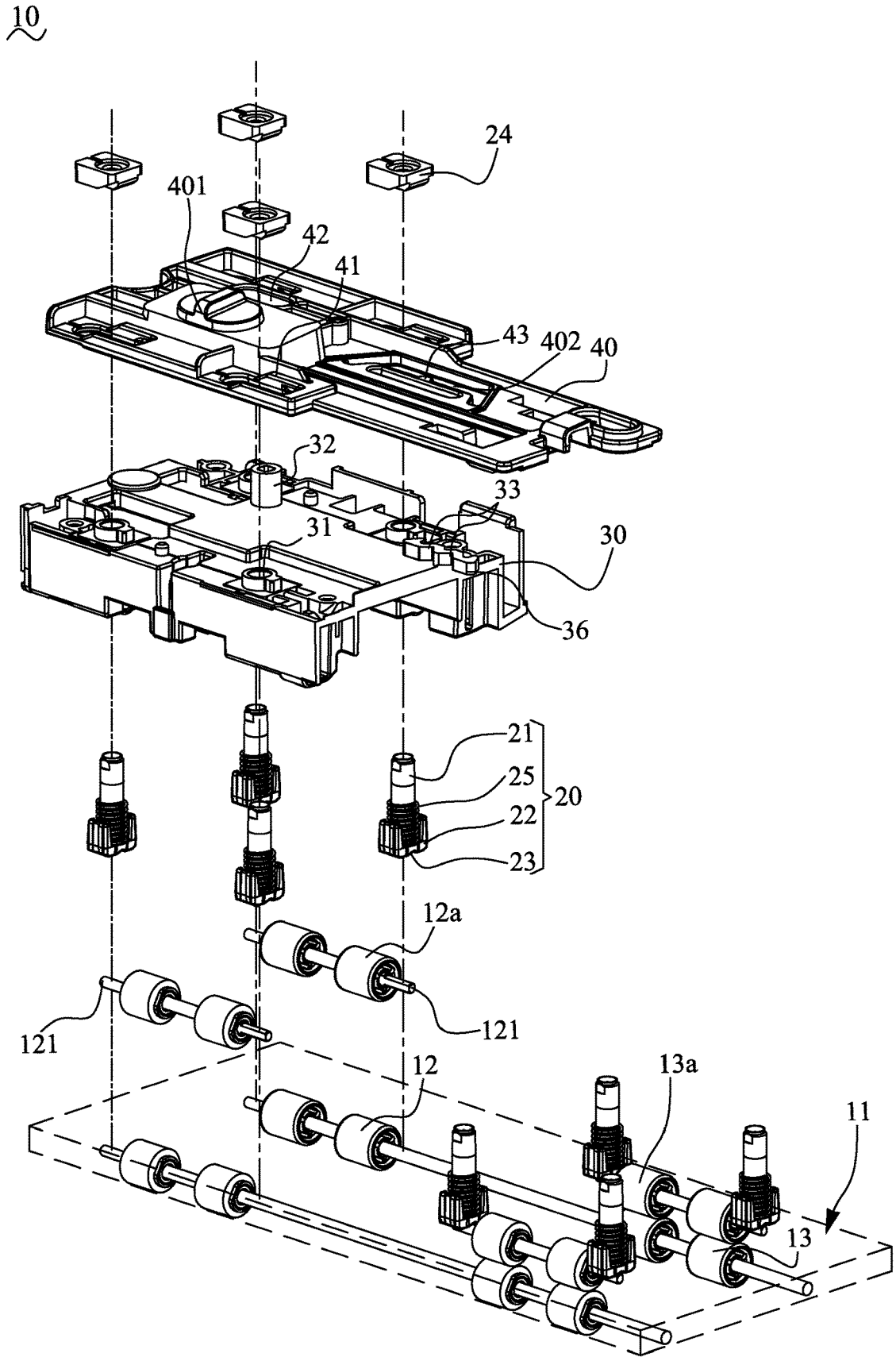
FIG. 1 is an exploded view of a sheet feeding mechanism in accordance with a preferred embodiment of the present invention.
Figure 2:
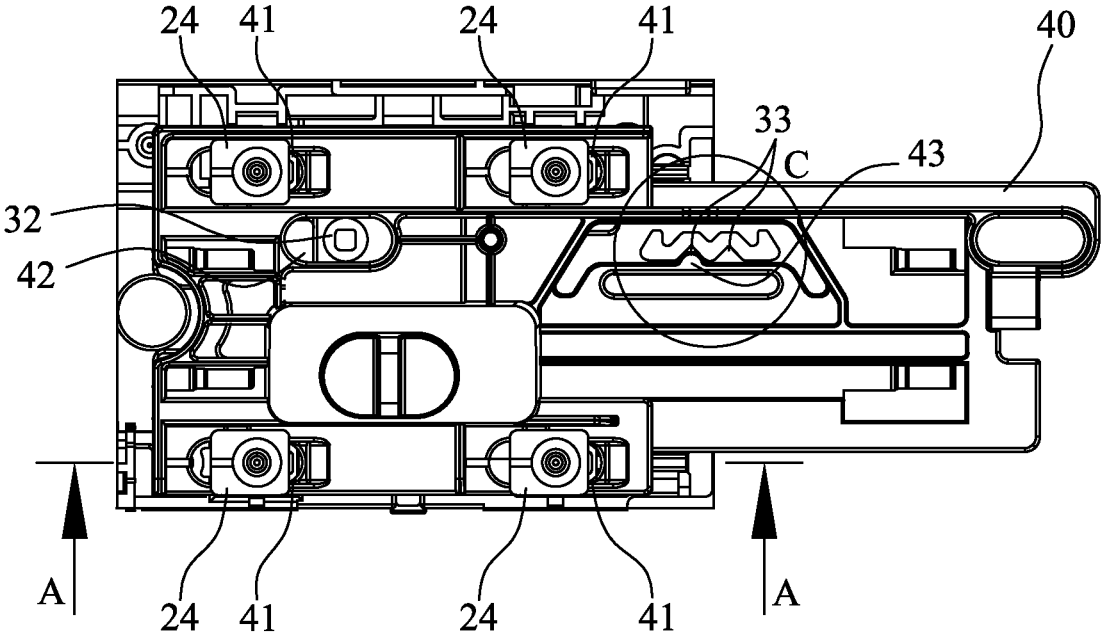
FIG. 2 is a top view of the sheet feeding mechanism, wherein a stroke limiting unit is moved to a lifting end of the sheet feeding mechanism of FIG. 1.
Figure 3:
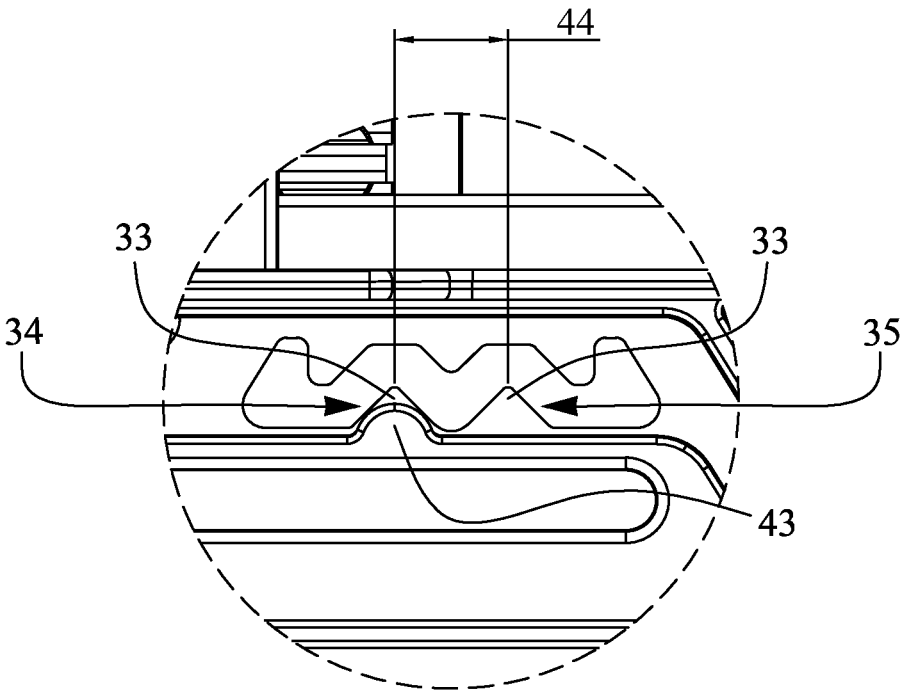
FIG. 3 is an enlarged view of an encircled portion C of FIG. 2.
Figure 4:
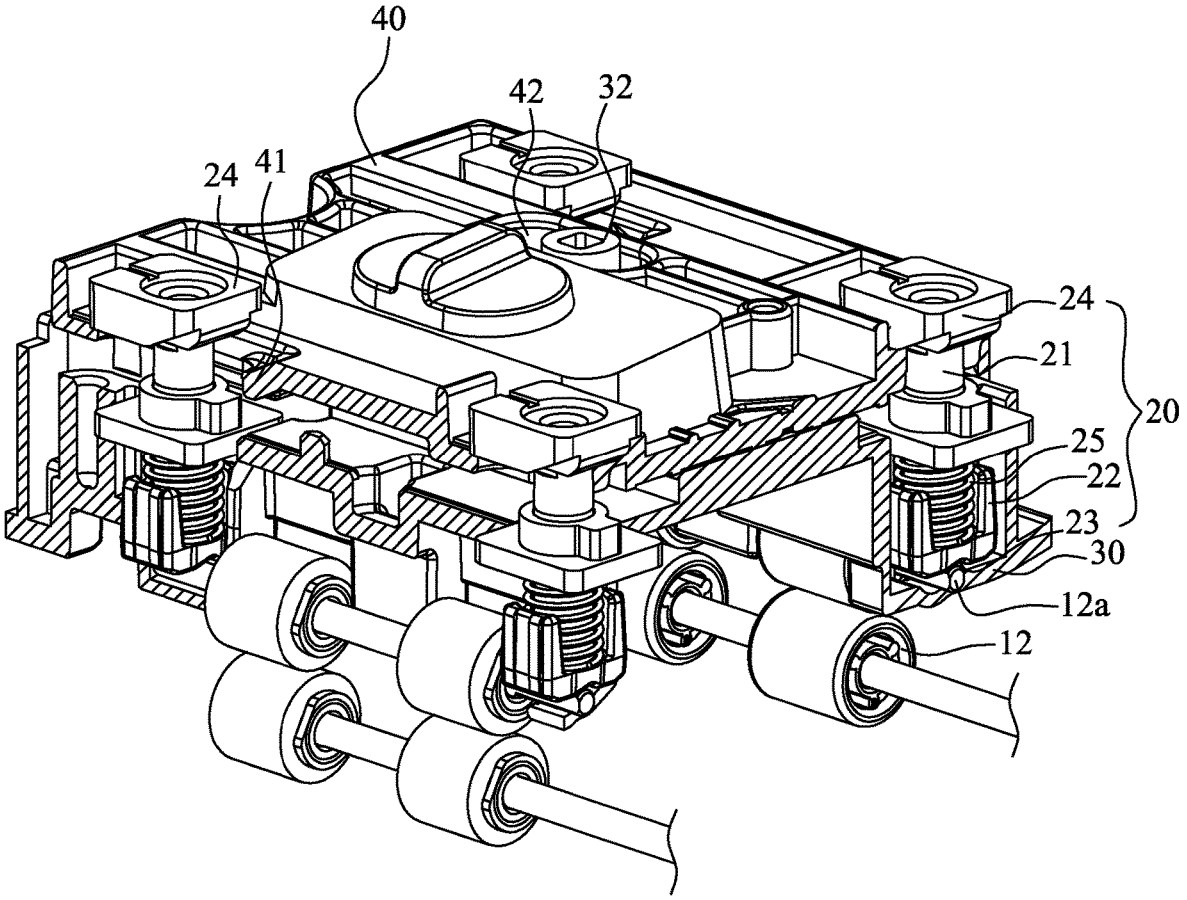
FIG. 4 is a partially sectional view of the sheet feeding mechanism of FIG. 1.

Referring to FIG. 1 to FIG. 4, a sheet feeding mechanism 10 in accordance with a preferred embodiment of the present invention is shown. The sheet feeding mechanism 10 includes a feeding path 11, at least one card feeding roller 12, at least one card idle roller 12*a*, at least one paper feeding roller 13, at least one paper idle roller 13*a*, at least one elastic unit 20, an orienting unit 30 and a stroke limiting unit 40.

The at least one card feeding roller 12 is mounted to the feeding path 11. The at least one paper feeding roller 13 is coaxial with the at least one card feeding roller 12. The at least one card idle roller 12*a* is mounted around a pivoting shaft 121. The at least one card idle roller 12*a* contacts with the at least one card feeding roller 12. The at least one paper idle roller 13*a* contacts with the at least one paper feeding roller 13. The at least one elastic unit 20 is connected to one side of the at least one card idle roller 12*a*. The at least one elastic unit 20 is fastened to the one side of the feeding path 11. The at least one elastic unit 20 has a stretching stroke 27. The stroke limiting unit 40 controllably shortens the stretching stroke 27. When the stretching stroke 27 is without being shortened by the stroke limiting unit 40, the at least one card idle roller 12*a* is located in the stretching stroke 27, when the stretching stroke 27 is shortened by the stroke limiting unit 40, the at least one card idle roller 12*a* is located outside a range of the stretching stroke 27.

Referring to FIG. 1 to FIG. 4, the sheet feeding mechanism 10 includes the feeding path 11, two groups of the card feeding rollers 12, two groups of the card idle rollers 12*a*, two groups of the paper feeding rollers 13, two groups of the paper idle rollers 13*a*, two groups of the elastic units 20, the orienting unit 30 and the stroke limiting unit 40. Each group of the card feeding rollers 12 include two card feeding rollers 12. Each group of the card idle rollers 12*a* include two card idle rollers 12*a*. Each group of the paper feeding rollers 13 include two paper feeding rollers 13. Each group of the paper idle rollers 13*a* include two paper idle rollers 13*a*.

The two groups of the card feeding rollers 12 are mounted to the feeding path 11. Each group of the paper feeding rollers 13 are coaxial with one group of the card feeding rollers 12. The two groups of the card idle rollers 12*a* are in contact with the two groups of the card feeding rollers 12, respectively. The two groups of the paper idle rollers 13*a* are in contact with the two groups of the paper feeding rollers 13, respectively. Each card idle roller 12*a* is connected with one elastic unit 20 to provide a normal clamping force towards the two groups of the card feeding rollers 12 for the two groups of the card idle rollers 12*a*. Each group of the card idle rollers 12*a* are mounted around the pivoting shaft 121. The sheet feeding mechanism 10 includes two pivoting shafts 121. Two free ends of the pivoting shaft 121 project beyond two outer sides of the two card idle rollers 12*a*.

In this preferred embodiment, each elastic unit 20 includes a sliding pin 21, an idle roller compressing block 22, a V-shaped fixing slot 23, a wedging block 24 and a compression spring 25. Each elastic unit 20 has a stretching stroke 27. The two groups of the elastic units 20 are connected to an upper side of the feeding path 11. The two groups of the elastic units 20 are fastened to the upper side of the feeding path 11. The orienting unit 30 is fastened to one side of a top of the feeding path 11. The orienting unit 30 has at least one orienting slot 31. The at least one orienting slot 31 is disposed towards the pivoting shaft 121 of the at least one card idle roller 12*a*. The orienting unit 30 has two groups of the orienting slots 31. The two groups of the orienting slots 31 are disposed corresponding to the sliding pins 21 of the two groups of the elastic units 20. The two groups of the orienting slots 31 are disposed towards the free ends of the pivoting shafts 121 of the two groups of the card idle rollers 12*a*. The two groups of the orienting slots 31 are disposed on the free ends of the pivoting shafts 121 of the two groups of the card idle rollers 12*a*. The at least one elastic unit 20 includes the sliding pin 21, the idle roller compressing block 22, the V-shaped fixing slot 23, the wedging block 24 and the compression spring 25. The sliding pin 21 is slidably disposed in the at least one orienting slot 31.

The sliding pins 21 of the two groups of the elastic units 20 are slidably positioned in the two groups of the orienting slots 31 of the orienting unit 30. In each elastic unit 20, the idle roller compressing block 22 is fixed to a lower end of the sliding pin 21 which faces towards the pivoting shaft 121 of one group of the card idle rollers 12*a*, and the wedging block 24 is fixed to an upper end of the sliding pin 21 away from the pivoting shaft 121 of the one group of the card idle rollers 12*a*. A middle of a bottom surface of the idle roller compressing block 22 is recessed inward to form the fixing slot 23. The pivoting shaft 121 is matched with the fixing slot 23. The free ends of the two pivoting shafts 121 are received in the fixing slots 23 of the two groups of the elastic units 20. The compression spring 25 is worn around the lower end of the sliding pin 21 with two ends of the compression spring 25 elastically abutting between the orienting unit 30 and the idle roller compressing block 22.

A direction of a sliding stroke 26 of the sliding pin 21 of each elastic unit 20 is limited by the orienting slot 31 of the orienting unit 30. A length of the sliding stroke 26 is limited between the wedging block 24 and the idle roller compressing block 22. A length of the stretching stroke 27 of each elastic unit 20 is further limited between the orienting unit 30 and the idle roller compressing block 22. When the sliding pin 21 is lifted upward, the stretching stroke 27 is compressed. When each group of the card idle rollers 12*a* are located within the stretching stroke 27, the compression springs 25 of two elastic units 20 push against the idle roller compressing blocks 22 of the two elastic units 20 to make the idle roller compressing blocks 22 of the two elastic units 20 exert a normal clamping force which is towards one group of the card feeding rollers 12 on the pivoting shaft 121 of the one group of the card idle rollers 12*a*. The pivoting shafts 121 of the two groups of the card idle rollers 12*a* are cooperated with the V-shaped fixing slots 23 of the two groups of the elastic units 20, and the pivoting shafts 121 of the two groups of the card idle rollers 12*a* are accommodated in the V-shaped fixing slots 23 of the two groups of the elastic units 20 to avoid the idle roller compressing blocks 22 and the card idle rollers 12*a* of the two groups of the elastic units 20 generate an accidentally lateral movement with respect to the orienting unit 30.

Figure 5:
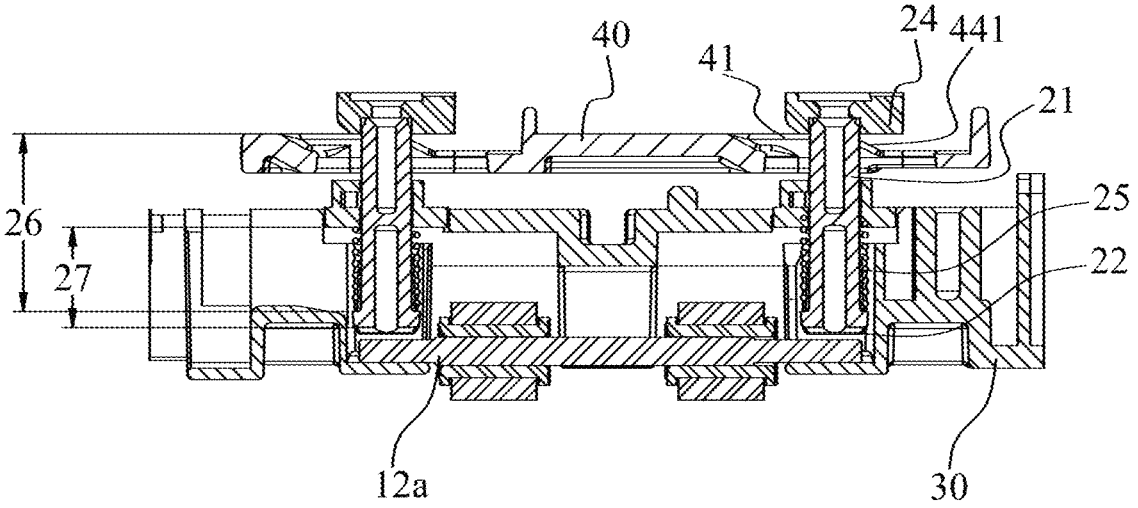
FIG. 5 is a sectional view of the sheet feeding mechanism along a line A-A of FIG. 2.
Figure 6:
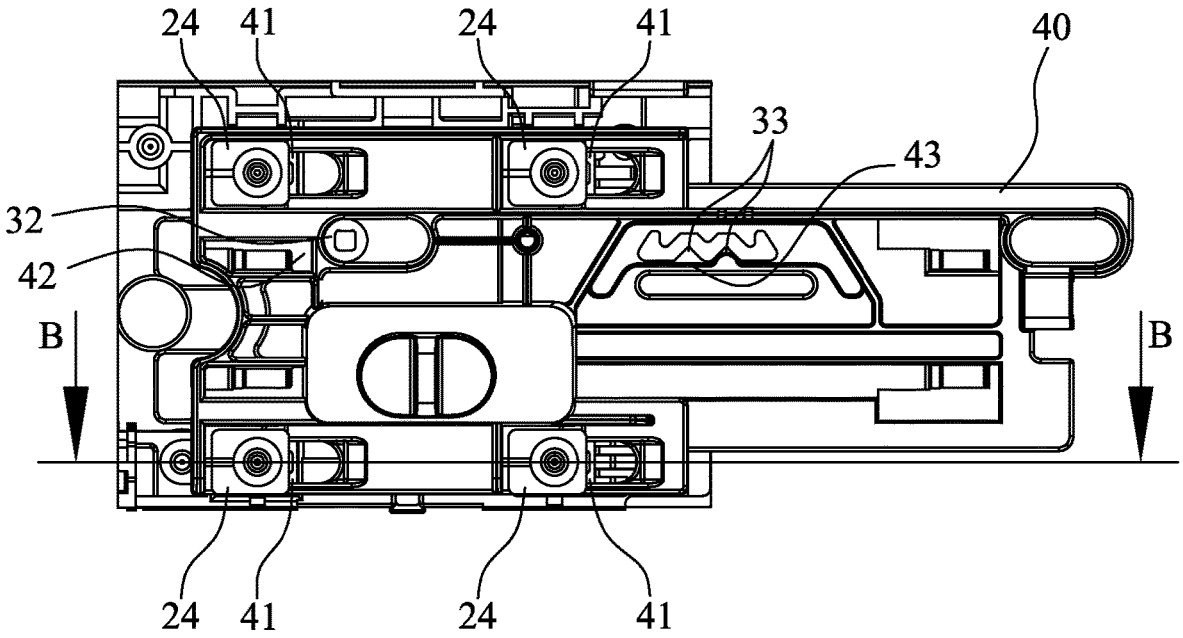
FIG. 6 is a top view of the sheet feeding mechanism, wherein the stroke limiting unit is moved to a release end of the sheet feeding mechanism of FIG. 1.
Figure 7:
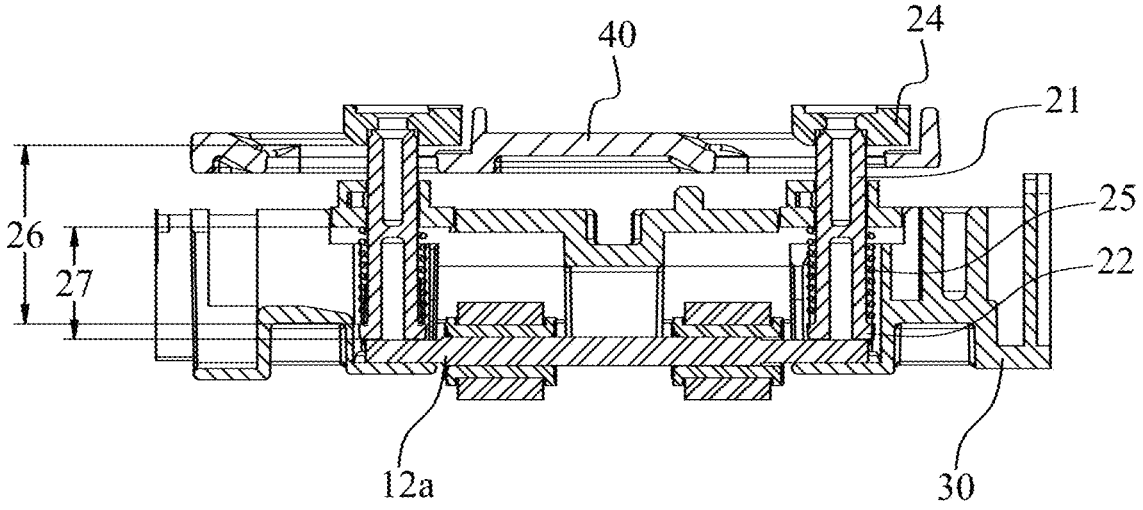
FIG. 7 is a sectional view of the sheet feeding mechanism along a line B-B of FIG. 6.
Figure 8:
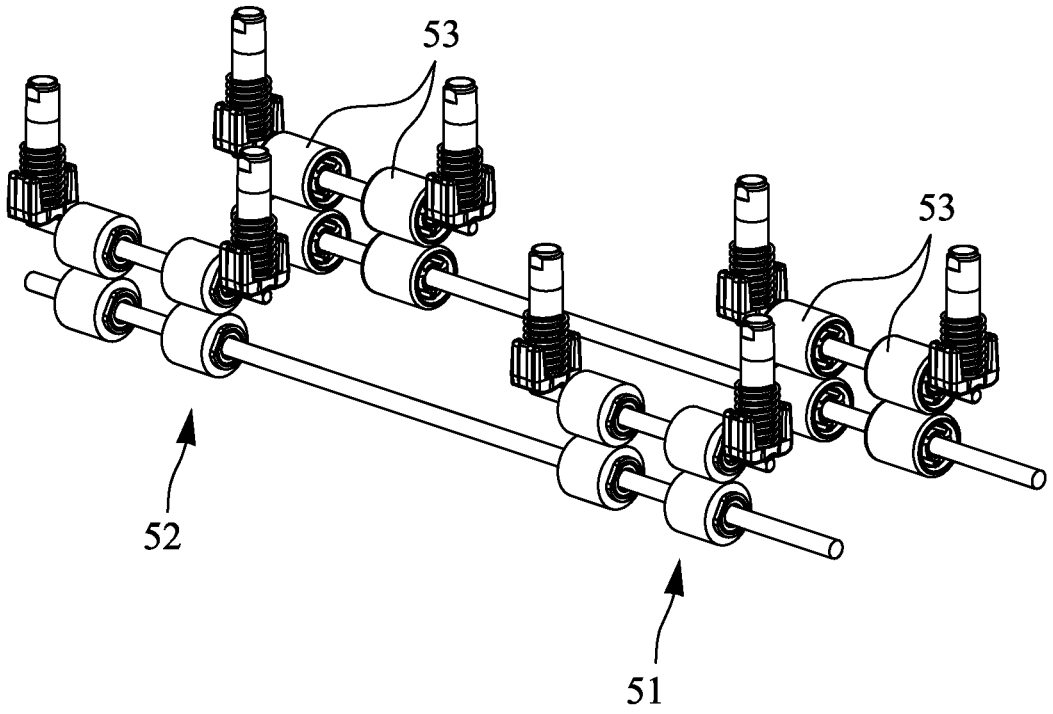
FIG. 8 (Prior Art)
FIG. 8 is a perspective view of a conventional sheet feeding mechanism in prior art.
Figure 9:
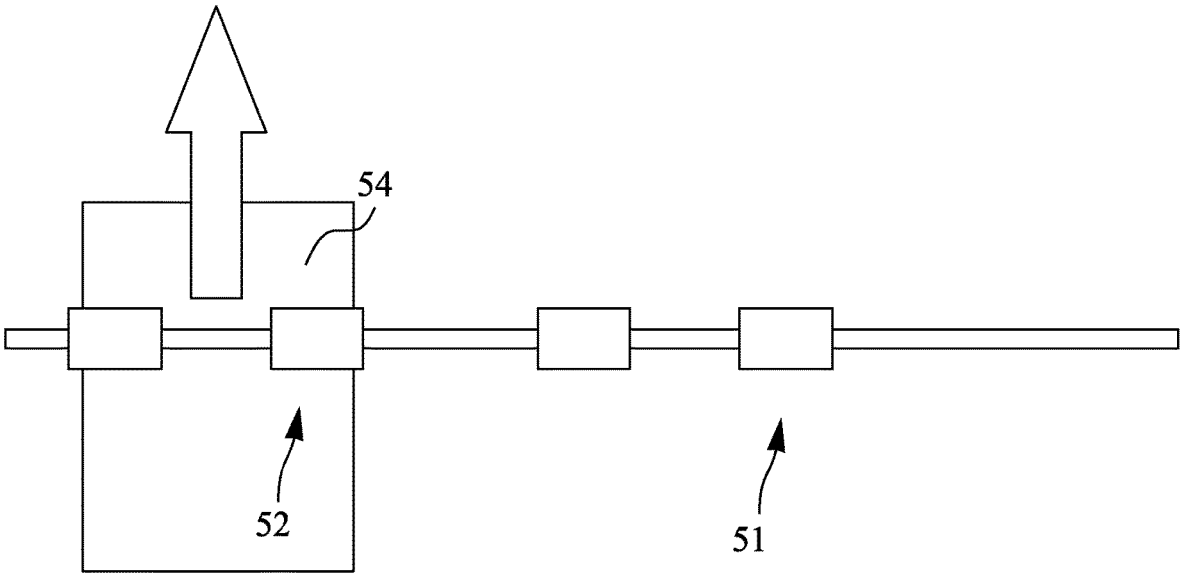
FIG. 9 (Prior Art)
FIG. 9 is a schematic diagram showing that a card is fed by a card feeding roller assembly of the conventional sheet feeding mechanism of FIG. 8.
Figure 10:
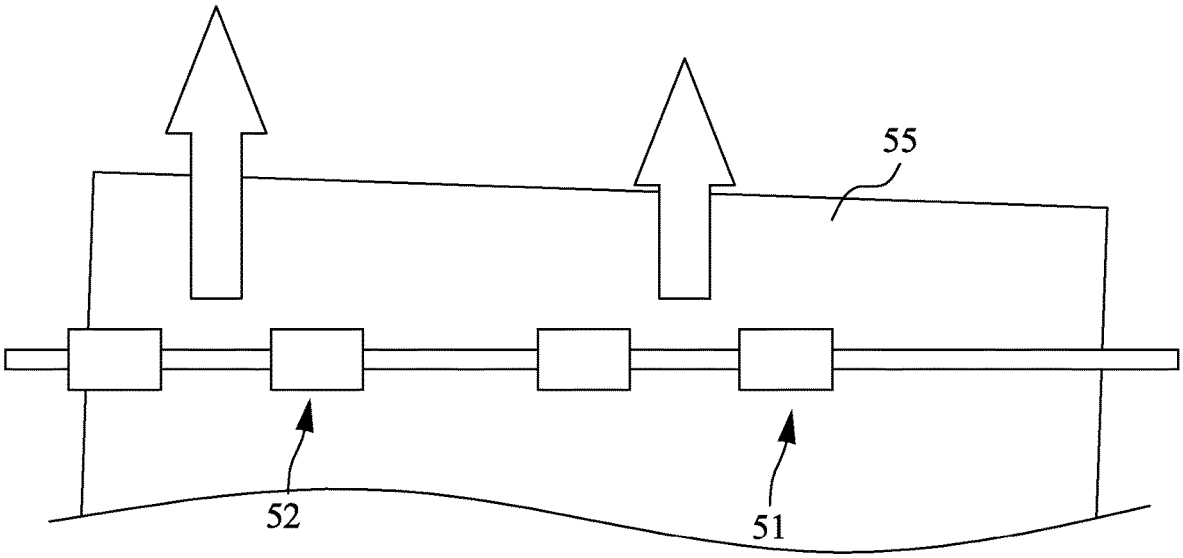
FIG. 10 (Prior Art)
FIG. 10 is a schematic diagram showing that paper is skewed due to uneven transmission forces exerted on both sides of the paper in the conventional sheet feeding mechanism of FIG. 8.

Referring to FIG. 1 to FIG. 7, when ordinary paper is fed, the ordinary paper contacts with the two groups of the card idle rollers 12*a* and the two groups of the paper idle rollers 13*a*, in order to avoid that uneven transmitting forces are exerted on two sides of the ordinary paper, even transmitting forces are exerted on the two sides of the paper, the sheet feeding mechanism 10 further includes the stroke limiting unit 40. The stroke limiting unit 40 slides on the orienting unit 30. The stroke limiting unit 40 includes at least one wedging slider 41. The at least one wedging slider 41 is slidably disposed between the orienting unit 30 and the wedging block 24 of the at least one elastic unit 20. The stroke limiting unit 40 includes a plurality of wedging sliders 41. The plurality of the wedging sliders 41 are slidably mounted on the orienting unit 30. The plurality of the wedging sliders 41 move under the wedging blocks 24 of the two groups of the elastic units 20, and the plurality of the wedging sliders 41 are propped against the wedging blocks 24 of the two groups of the elastic units 20 for shortening the stretching stroke 27 of each elastic unit 20. One side of each wedging slider 41 has an inclined surface 441 slantwise extending sideward and downward. Each elastic unit 20 is guided by the inclined surface 441 of one wedging slider 41 to slide on the one wedging slider 41 or slide away from the one wedging slider 41.

A top of the stroke limiting unit 40 is equipped with a button 401. A user sideward pushes the button 401 or pulls the button 401 to make the stroke limiting unit 40 slide on the orienting unit 30. The button 401 with the stroke limiting unit 40 slides sideward to drive each elastic unit 20 to slide on the one wedging slider 41 or slide away from the one wedging slider 41.

When the paper is to be fed, the button 401 is pushed sideward to make the plurality of the wedging sliders 41 of the stroke limiting unit 40 slide under the wedging blocks 24 of the two groups of the elastic units 20. The plurality of the wedging blocks 24, the sliding pins 21 and the idle roller compressing blocks 22 of the two groups of the elastic units 20 are lifted by the plurality of the wedging sliders 41 of the stroke limiting unit 40, and the compression spring 25 of each elastic unit 20 is without exerting an elasticity on the two groups of the card idle rollers 12*a*. The stretching stroke 27 of each elastic unit 20 is shortened by the stroke limiting unit 40, the two groups of the card idle rollers 12*a* are located out of the stretching stroke 27, at the moment, the paper is placed to the sheet feeding mechanism 10, and the paper is driven by the two groups of the paper idle rollers 13*a*.

When the card is to be fed, the button 401 is pushed sideward to make the plurality of the wedging sliders 41 of the stroke limiting unit 40 slide away from the wedging blocks 24 of the two groups of the elastic units 20. The wedging blocks 24, the sliding pins 21 and the idle roller compressing blocks 22 of the two groups of the elastic units 20 are slid downward via compressing forces of the compression springs 25 of the two groups of the elastic units 20 which are compressed between the idle roller compressing blocks 22 of the two groups of the elastic units 20 and the orienting unit 30. The idle roller compressing blocks 22 of the two groups of the elastic units 20 are pushed to press the two pivot shafts 121 of the two groups of the card idle rollers 12*a*. The compression spring 25 of each elastic unit 20 exerts the elasticity on the two groups of the card idle rollers 12*a*, the stretching stroke 27 of each elastic unit 20 is without being shortened by the stroke limiting unit 40, the two groups of the card idle rollers 12*a* are located in the range of the stretching stroke 27, at the moment, the card is placed to the sheet feeding mechanism 10, and the card is driven by the two groups of the card idle rollers 12*a*.

Referring to FIG. 1 to FIG. 7 again, a top of the orienting unit 30 has a guiding slider 32 and two substantially V-shaped positioning notches 33. The stroke limiting unit 40 has a guiding slot 42, a locating groove 402 and a positioning reed 43. The top of the orienting unit 30 has a zigzag protrusion 36, and the two positioning notches 33 are formed on a side wall of the zigzag protrusion 36. The guiding slot 42 penetrates through one side of the stroke limiting unit 40 along an up-down direction. The locating groove 402 penetrates through the other side of the stroke limiting unit 40 along the up-down direction. An inner surface of a front wall of the locating groove 402 is arched outward to form the positioning reed 43. The guiding slider 32 is cooperated with the guiding slot 42. The guiding slider 32 is accommodated in the guiding slot 42 to guide the stroke limiting unit 40 to slide along a guiding stroke 44. The positioning reed 43 is alternatively cooperated with the two positioning notches 33. The zigzag protrusion 36 is accommodated in the locating groove 402. The positioning reed 43 of the stroke limiting unit 40 is slid on the side wall of the zigzag protrusion 36, and the positioning reed 43 of the stroke limiting unit 40 is alternatively buckled in the two positioning notches 33, so that the stroke limiting unit 40 is held at a current position which is chosen by the user. The guiding stroke 44 has a lifting end 34 and a release end 35. The two positioning notches 33 are defined as the lifting end 34 and the release end 35, respectively. The positioning reed 43 is movable from one positioning notch 33 to the other positioning notch 33. Therefore, the stroke limiting unit 40 moves along a sideward direction and a front-to-rear direction. In the sideward direction, the two groups of the elastic units 20 slide on the plurality of the wedging sliders 41 of the stroke limiting unit 40 or slide away from the plurality of the wedging sliders 41 of the stroke limiting unit 40. In the front-to-rear direction, the positioning reed 43 of the stroke limiting unit 40 alternatively slides in the two positioning notches 33 or the positioning reed 43 of the stroke limiting unit 40 slides away from the two positioning notches 33.

Referring to FIG. 2, FIG. 5, FIG. 6 and FIG. 7, when the stroke limiting unit 40 moves to the lifting end 34, the plurality of the wedging sliders 41 slide under bottoms of the wedging blocks 24 of the two groups of the elastic units 20 to prop up the wedging blocks 24 of the two groups of the elastic units 20, and then the sliding pins 21 of the two groups of the elastic units 20 are lifted, and the stretching stroke 27 of each elastic unit 20 is shortened, the two groups of the card idle rollers 12*a* exceed the range of the stretching stroke 27. When the stroke limiting unit 40 moves to the release end 35, the plurality of the wedging sliders 41 leave from the bottoms of the wedging blocks 24 of the two groups of the elastic units 20 and the plurality of the wedging blocks 24 of the two groups of the elastic units 20 are released, the sliding pins 21 of the two groups of the elastic units 20 are descended, so a total length of the stretching stroke 27 is lengthened, the two groups of the card idle rollers 12*a* are in the range of the stretching stroke 27, and the bottom surfaces of the idle roller compressing blocks 22 of the two groups of the elastic units 20 contact with the two groups of the card idle rollers 12*a*.

As described above, the stroke limiting unit 40 of the sheet feeding mechanism 10 can adjust the length of the stretching stroke 27 of each elastic unit 20 for controlling the normal clamping force exerted on the two groups of the card feeding rollers 12 by the two groups of the card idle rollers 12*a*, so that the sheet feeding mechanism 10 realizes that the paper and the card are fed through the same feeding path 11, correspondingly the sheet feeding mechanism 10 has two feeding modes. Furthermore, even transmitting forces are exerted on the two sides of the paper, so the sheet feeding mechanism 10 is capable of avoiding the paper from causing a skew.

What is claimed is:

1. A sheet feeding mechanism, comprising:

a feeding path;

at least one card feeding roller mounted to the feeding path;

at least one paper feeding roller coaxial with the at least one card feeding roller;

at least one card idle roller contacting with the at least one card feeding roller;

at least one paper idle roller contacting with the at least one paper feeding roller;

at least one elastic unit connected to one side of the at least one card idle roller, the at least one elastic unit being fastened to one side of the feeding path, the at least one elastic unit having a stretching stroke; and a stroke limiting unit controllably shortening the stretching stroke, wherein when the stretching stroke is without being shortened by the stroke limiting unit, the at least one card idle roller is located in the stretching stroke, when the stretching stroke is shortened by the stroke limiting unit, the at least one card idle roller is located outside a range of the stretching stroke.

2. The sheet feeding mechanism as claimed in claim 1, further comprising an orienting unit, the orienting unit being fastened to one side of a top of the feeding path, the orienting unit having at least one orienting slot, the at least one orienting slot being disposed towards a pivoting shaft of the at least one card idle roller, the at least one elastic unit including a sliding pin, the sliding pin being slidably disposed in the at least one orienting slot.

3. The sheet feeding mechanism as claimed in claim 2, wherein the at least one elastic unit includes an idle roller compressing block, a wedging block and a compression spring, the idle roller compressing block is fixed to a lower end of the sliding pin which faces towards the pivoting shaft, the wedging block is fixed to an upper end of the sliding pin away from the pivoting shaft, the compression spring is worn around the lower end of the sliding pin with two ends of the compression spring elastically abutting between the orienting unit and the idle roller compressing block.

4. The sheet feeding mechanism as claimed in claim 3, wherein a middle of a bottom surface of the idle roller compressing block is recessed inward to form a fixing slot, the pivoting shaft is matched with the fixing slot.

5. The sheet feeding mechanism as claimed in claim 3, wherein the stroke limiting unit has a guiding slot, the guiding slot penetrates through one side of the stroke limiting unit along an up-down direction, the stroke limiting unit includes at least one wedging slider, the at least one wedging slider is slidably disposed between the orienting unit and the wedging block of the at least one elastic unit, a top of the orienting unit has a guiding slider, the guiding slider is cooperated with the guiding slot, the guiding slider is accommodated in the guiding slot to guide the stroke limiting unit to slide along a guiding stroke, the guiding stroke has a lifting end and a release end.

6. The sheet feeding mechanism as claimed in claim 5, wherein the top of the orienting unit has two substantially V-shaped positioning notches, the two positioning notches are defined as the lifting end and the release end, respectively, the stroke limiting unit has a positioning reed, the positioning reed is alternatively cooperated with the two positioning notches, the positioning reed is alternatively buckled in the two positioning notches.

7. A sheet feeding mechanism, comprising:

a feeding path;

two groups of card feeding rollers mounted to the feeding path;

two groups of paper feeding rollers, each group of the paper feeding rollers being coaxial with one group of the card feeding rollers;

two groups of card idle rollers in contact with the two groups of the card feeding rollers, respectively;

two groups of paper idle rollers in contact with the two groups of the paper feeding rollers, respectively;

two groups of elastic units fastened to an upper side of the feeding path, each card idle roller being connected with one elastic unit, each elastic unit having a stretching stroke; and a stroke limiting unit controllably shortening the stretching stroke, wherein when the stretching stroke of each elastic unit is shortened, the two groups of the card idle rollers exceed a range of the stretching stroke, when the stretching stroke is lengthened, the two groups of the card idle rollers are in the range of the stretching stroke.

8. A sheet feeding mechanism, comprising:

a feeding path;

two groups of card feeding rollers mounted to the feeding path;

two groups of paper feeding rollers, each group of the paper feeding rollers being coaxial with one group of the card feeding rollers;

two groups of card idle rollers in contact with the two groups of the card feeding rollers, respectively, each group of the card idle rollers being mounted around a pivoting shaft;

two groups of paper idle rollers in contact with the two groups of the paper feeding rollers, respectively;

two groups of elastic units fastened to an upper side of the feeding path, each card idle roller being connected with one elastic unit, each elastic unit including a sliding pin, each elastic unit having a stretching stroke;

an orienting unit fastened to one side of a top of the feeding path, the orienting unit having two groups of orienting slots, the two groups of the orienting slots being disposed towards free ends of the pivoting shafts of the two groups of the card idle rollers, the sliding pins of the two groups of the elastic units being slidably positioned in the two groups of the orienting slots of the orienting unit; and a stroke limiting unit controllably shortening the stretching stroke, wherein when the stretching stroke of each elastic unit is shortened, the two groups of the card idle rollers exceed a range of the stretching stroke, when the stretching stroke is lengthened, the two groups of the card idle rollers are in the range of the stretching stroke.

* * * * *